United States Patent [19]

Barrett

[11] 4,364,327

[45] Dec. 21, 1982

[54] STRIPPING EXCESS COATING LIQUID FROM MOVING STRIP MATERIALS

[75] Inventor: Richard C. Barrett, Mount Ousley, Australia

[73] Assignee: John Lysaght (Australia) Limited, Sydney, Australia

[21] Appl. No.: 276,999

[22] Filed: Jun. 24, 1981

[30] Foreign Application Priority Data

Jan. 21, 1981 [AU] Australia ..... 66384/81

[51] Int. Cl.[3] ..... B05C 11/02

[52] U.S. Cl. ..... 118/102; 118/122; 118/123

[58] Field of Search ..... 118/126, 63, 102, 122, 118/123

[56] References Cited

U.S. PATENT DOCUMENTS 2,960,063 11/1960 Martuch ..... 118/102

3,381,506 5/1968 Cram ..... 118/123 X 3,459,153 8/1969 Alix ..... 118/102

FOREIGN PATENT DOCUMENTS 453826 2/1973 Australia .

*Primary Examiner*—Shrive P. Beck

*Attorney, Agent, or Firm*—Jenkins, Coffey, Hyland, Badger & Conard

[57] ABSTRACT

In gas stripping excess coating material (such as molten zinc) from rising sheet material (such as continuous steel strip) uneven coating adjacent the strip edges is deterred by a baffle plate having a vertical portion held close to but not touching the strip and disposed normally to the strip edge, and a remainder portion trended away from that edge. The baffle plate is fixed on one end of a carrier plate suspended on a truck spring urged towards the sheet. The carrier plate extends further from the strip edge than does said remainder portion and the horizontal length of the carrier plate is from 10 to 20 times the width of said vertical portion.

4 Claims, 2 Drawing Figures

STRIPPING EXCESS COATING LIQUID FROM MOVING STRIP MATERIALS

This invention relates to apparatus for use in stripping excess coating liquid from an upwardly moving strip; more specifically, apparatus of the kind subject of our prior Australian Pat. No. 453,826.

The apparatus of the said prior patent has proved itself to be of considerable practical value; and this, in production of coated strip steel on a scale amounting to over half a million tonnes of strip per annum.

That use however, has shown that the prior apparatus is not without its shortcomings: namely:

(a) In operation the prior apparatus turned out to be noisy beyond tolerance due to gas turbulence resulting from unavoidable placement of the apparatus close to the strip and. in the flow-off path of the stripping gas stream.

(b) The rejection rate of coated strip (under test for coating thickness in the strip-edge region) is of the order of 0.8% to 1% of total coated strip production. This reject rate was a substantial improvement compared with that obtaining under gas-stripping coating practices followed before the onset of the said prior patent, but even so when coated strip production is on the scale previously indicated herein such a reject rate represents a considerable economic loss.

(c) Our use of the prior invention revealed that the gauge thickness of strip capable of being handled, with economic advantage, by use of that invention was limited to a strip thickness of about 2.5 mm.

(d) In operation of the said prior invention it was found that particles of coating material were deposited within the rails (marked 9 in the drawings of the prior patent) and accumulated therein to the obstruction of free movability on the part of the baffle assemblage. This occasioned frequent halting of a production run to clear away the accumulates. This in itself was bad enough, but was made worse owing to the virtual inaccessibility of the rail surfaces to be cleaned.

(e) The prior apparatus, in order to function with reasonable efficiency, required the upright portion of the baffle plate (marked 2*a* in the drawings of the prior patent) to be of a width which substantially overspanned the "flap" amplitude of which the strip was capable during rapid movement thereof. This "flap" overspan on the part of the baffle plate, while found necessary in the prior apparatus, was somewhat of a disadvantage since it obstructed optimum close approach of the stripping jet nozzles to the strip.

(f) Progressive increase in the demand for steel strip coated with an aluminium/zinc alloy has shown that while the prior apparatus gives some benefit when applied to that purpose, the foregoing shortcomings (a) to (e) are exacerbated.

The object of the present invention is to remedy or ameliorate the shortcomings listed above. In its simplest expression, the present invention is primarily concerned to remedy the first stated shortcoming (a) at least to the extent of reducing the noise operation down to a level which is readily tolerable even over the sustained operational periods necessary for continuous coated strip production.

In its preferred embodiment (an example of which is illustrated in the drawings herewith) the invention is directed in remedy of all of the shortcomings listed above as (a) to (f).

With regard to the noise aspect discussed above, it will be noted that in our said prior patent reference is made to a support plate (3) present merely as a convenient way of mounting the baffle plate; and, extensive research in an endeavour to find an effective noise suppressant led to the relatively simple discovery that if this plate is suitably proportioned relative to the baffle carried by it, the plate, while still serving as a carrier for the baffle, becomes a highly effective noise suppresser.

Thus, the present invention provides apparatus for stripping excess coating liquid from an upwardly moving strip, of the kind comprising: a baffle plate having a vertical portion presented to the edge of said strip and a non-vertical remainder portion trended away from said edge, a carrier plate having said baffle plate fixed along one edge of it, a truck movable towards and away from said strip edge and having said carrier plate suspended from it, means urging said truck to approach said strip edge, and means to maintain a minimum spacing between said strip edge and said vertical portion;

characterised in that said carrier plate extends further from said strip edge than does said non-vertical portion, and the horizontal length of said carrier plate is from ten to twenty times the horizontal width of said vertical portion.

In the drawings herewith,

Figure 1:
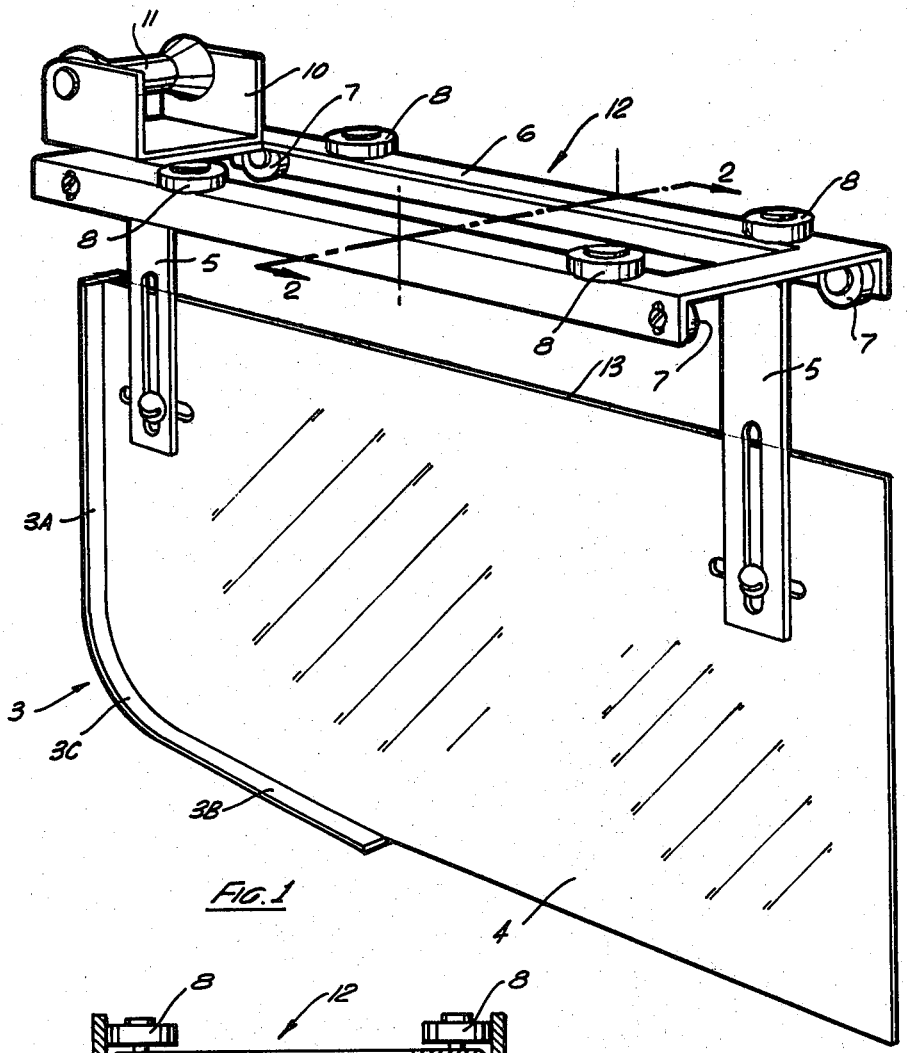
FIG. 1 is a perspective view.
Figure 2:
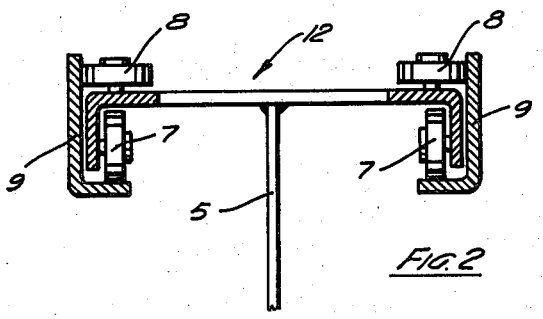
FIG. 2 is a section taken on plane 2—2 in FIG. 1.

Referring to those drawings, a baffle plate 3 consists of a vertical portion 3A and a non-vertical portion comprising straight bottom 3B and an arcuate transition portion 3C.

In connection with this plate 3, experiment has shown that its horizontal width may be about half as great as formerly thought necessary, as, in conjunction with the other characteristics of the invention (as later described herein) such width reduction does not impair the effectiveness of the baffle plate in performance of its assigned function, and enables the stripping jet nozzles (which necessarily extend beyond the width of the strip under treatment) to be adjusted unobstructedly into optimum closeness relative to the strip.

By the present invention the horizontal width of baffle plate 3 may be of the order of 2.5 cm. whereas in the prior apparatus 5 cm. was the minimum for effective functioning of the baffle plate.

Plate 3 is fixedly mounted on a carrier plate 4 whereof the horizontal length exceeds the combined length of baffle plate portions 3B and 3C. Preferably the horizontal length of plate 4 is about twice 3B+3C.

Plate 4 is suspended on two hangers 5 having their upper ends fixed to a truck 6. This truck is provided with rollers 7 and 8 so that the truck may run freely along a pair of stationarily-mounted angle-sectioned rails 9. Truck 6 carries a yoke 10 for a roller 11 able to ride the edge of a strip being treated.

Truck 6 has a large aperture 12 formed in it. This aperture is centred over the upper edge 13 of plate 4, is almost as long as that edge and much wider than it. It is found in use, that upward splash or blast-borne particles of coating material are swept through aperture 13 for collection by conventional means (not shown) instead of being deposited on rails 9 or on rollers 7 and 8. This provision reduces cleaning frequency, and even when such cleaning is necessary, that process is greatly facilitated since the whole assembly (as shown in FIG. 1) may simply be lifted clear of rails 9; and, as well, the runway surfaces of those rails are readily accessible for cleaning.

It will be appreciated that since the onset of the said prior patent, the apparatus thereof has been the subject of sustained testing and experimentation which culminated in the present invention.

That testing and experimentation (in relation to production of coated strip running into millions of tonnes) has amply confirmed a number of the findings previously expressed herein. For example, in the previous paragraph hereof lettered (b) it was stated that with the previously patented apparatus a strip rejection rate of from 0.8% to 1% was obtained. By the present invention that rejection rate has been reduced to one eighth or less of its former minimum value; namely, from 0.8% to 0.1%. In some production runs a rejection rate of less than 0.1% is obtained.

In paragraph (c) reference was made to the apparatus of the former invention being usefully applicable only to strip not exceeding about 2.5 mm. in thickness. By the present invention we have found that strip of any thickness (substantially in excess of 2.5 mm.) may be successfully treated provided it remains sufficiently flexible for transit through the bath of molten coating material, and for reeling after stripping.

In the prior patent it was intimated that the track (7 in the prior drawings) was influenced to bear towards the strip edge by the stripping gas blast, and that this influence could be augmented by the truck being spring loaded, or by the rails (9) "slightly" being tilted downwardly towards the strip. Sustained usage has shown that when tilting of the rails is relied upon to give this extra loading effect, the degree of downhill tilt is rather more than would generally be implied by the term "slightly", and this is particularly so when the strip is being coated with aluminium/zinc alloy, as in that case the pressure of the stripping gas blast is preferably not as great as it would be for ordinary zinc stripping. We have now found that stripping generally will be effectively carried out if the downhill tilt of the rails 9 is between 5° to 10° from the horizontal. If this tilt is less than 5° the truck tends to return to strip engagement (by roller 11) too slowly, and if the angle exceeds 10° the strip edge may be impaired by too forceful return of roller 11. Especially is this so when the strip is of light gauge.

Earlier herein it was stipulated that the horizontal length of the carrier plate be from 10 to 20 times greater than the horizontal width of the baffle plate. The preferred proportion is 15 times greater. If this proportion is less than 10 times, the noise level starts to become objectionable. If it is more than 20 times, no further noise reduction is found to accrue.

I claim:

1. Apparatus for use in stripping excess coating liquid from a strip moving upwardly in the direction of its length, and of the kind comprising: a baffle plate having a top portion whereof the length extends parallel to an edge of said strip and the width extends on either side of the plane of said strip, and a bottom portion which extends from the bottom of said top portion and is trended away from said strip edge, a carrier plate disposed substantially co-planar with the strip and having said baffle plate mounted on that edge of said carrier plate nearest to said strip, a truck movable towards and away from said strip edge and having said carrier plate suspended from it, means urging said truck to approach said strip edge, and means to maintain a minimum spacing between said strip edge and said top portion;

characterised in that said carrier plate extends further away from said strip than does said bottom portion, and the length of said carrier plate in the direction normal to said strip edge is from ten to twenty times the width of said top portion.

2. Apparatus according to claim 1 wherein said truck is furnished with an aperture positioned directly above said carrier plate and through which upwardly-travelling particles of coating material are able to pass.

3. Apparatus according to claim 1 wherein said truck is furnished with rollers which ride a pair of angle-sectioned rails so positioned and spaced apart as to permit said truck and the matters suspended thereon to be lifted bodily through the space between said rails.

4. Apparatus according to claim 3 wherein said rails are tilted downwardly towards said strip edge at an angle of from 5° to 10° from horizontal.

* * * * *

UNITED STATES PATENT AND TRADEMARK OFFICE

CERTIFICATE OF CORRECTION

PATENT NO. : 4,364,327

DATED : December 21, 1982

INVENTOR(S) : Richard C. Barrett

It is certified that error appears in the above-identified patent and that said Letters Patent is hereby corrected as shown below:

Column 3, line 29, delete "track" and insert therefor --truck--.

Signed and Sealed this

*Fifteenth* Day of *March 1983*

[SEAL]

*Attest:*

GERALD J. MOSSINGHOFF

*Attesting Officer*

*Commissioner of Patents and Trademarks*